US010019938B2

(12) United States Patent
Gu

(10) Patent No.: US 10,019,938 B2
(45) Date of Patent: Jul. 10, 2018

(54) ORGANIC LIGHT EMITTING DIODE PIXEL DRIVING CIRCUIT AND DISPLAY DEVICE

(71) Applicants: Shanghai Tianma AM-OLED Co., Ltd., Shanghai (CN); Tianma Micro-Electronics Co., Ltd., Shenzhen (CN)

(72) Inventor: Hanyu Gu, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 0 days.

(21) Appl. No.: 14/470,833

(22) Filed: Aug. 27, 2014

(65) Prior Publication Data

US 2015/0364082 A1 Dec. 17, 2015

(30) Foreign Application Priority Data

Jun. 13, 2014 (CN) ..... 2014 1 0264419

(51) Int. Cl.
*G09G 3/3258* (2016.01)
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 2300/0804* (2013.01);
(Continued)

(58) Field of Classification Search
CPC ..... G09G 3/30; G09G 3/32; G09G 3/3208; G09G 3/3225; G09G 3/3233
See application file for complete search history.

(56) References Cited

U.S. PATENT DOCUMENTS

2011/0109299 A1* 5/2011 Chaji ..... G09G 3/3283 324/76.11
2011/0148847 A1* 6/2011 Ikeda ..... G09G 3/3233 345/212

(Continued)

FOREIGN PATENT DOCUMENTS

CN 1741109 A 3/2006
DE 102011078864 A1 3/2012

(Continued)

OTHER PUBLICATIONS

Office Action as issued in corresponding German Application 102014114955.6, dated May 18, 2015 and English translation thereof.

(Continued)

*Primary Examiner* — Carolyn R Edwards
*Assistant Examiner* — Bipin Gyawali
(74) *Attorney, Agent, or Firm* — Alston & Bird LLP

(57) ABSTRACT

An organic light emitting diode pixel driving circuit and a display device are disclosed. The circuit includes an external circuit and intra-pixel circuits, which each include a signal loading module, a driving transistor, and an organic light emitting diode. The external circuit loads a data signal to the driving transistors of the intra-pixel circuits during a signal loading phase, and each of the signal loading modules generates a drive signal based on a signal at the source of the driving transistor and on the threshold voltage thereof, to store the drive signal, to load the drive signal to the gate of the driving transistor during the signal loading phase, and to control the driving transistor by the drive signal stored in the signal loading phase and the signal at the source of the driving transistor to cause the organic light emitting diode to emit light during a light emitting phase.

8 Claims, 9 Drawing Sheets

(52) U.S. Cl.
CPC ..... *G09G 2300/0814* (2013.01); *G09G 2300/0819* (2013.01); *G09G 2300/0861* (2013.01); *G09G 2300/0866* (2013.01); *G09G 2310/08* (2013.01); *G09G 2320/043* (2013.01); *G09G 2320/045* (2013.01)

(56) References Cited

U.S. PATENT DOCUMENTS

| | | | | |
|---|---|---|---|---|
| 2011/0221940 | A1 | 9/2011 | Kato et al. | |
| 2012/0062536 | A1* | 3/2012 | Park | G09G 3/3233 345/211 |
| 2012/0139892 | A1* | 6/2012 | Oh | G09G 3/3648 345/212 |
| 2014/0152705 | A1* | 6/2014 | Kwon | G09G 3/3275 345/690 |
| 2015/0103037 | A1* | 4/2015 | Wu | G09G 3/3233 345/174 |

FOREIGN PATENT DOCUMENTS

| | | | |
|---|---|---|---|
| DE | 102011055858 | A1 | 9/2012 |
| KR | 1020050038906 | A | 4/2005 |
| KR | 100903496 | B1 | 6/2009 |
| KR | 1020120009671 | A | 2/2012 |

OTHER PUBLICATIONS

Office Action as received in corresponding Chinese Application 201410264419.8, dated Oct. 27. 2015.

* cited by examiner

ORGANIC LIGHT EMITTING DIODE PIXEL DRIVING CIRCUIT AND DISPLAY DEVICE

CROSS REFERENCE TO RELATED APPLICATIONS

This application claims priority to Chinese Patent Application No. 201410264419.8 filed on Jun. 13, 2014 and entitled "ORGANIC LIGHT EMITTING DIODE PIXEL DRIVING CIRCUIT AND DISPLAY DEVICE", the content of which is incorporated herein by reference in its entirety.

TECHNICAL FIELD

The present invention relates to the field of display technologies and particularly to an organic light emitting diode pixel driving circuit and a display device.

BACKGROUND OF THE INVENTION

An Active Matrix Organic Light Emitting Diode (AMOLED) display has been widely applied due to its wide angle of view, good color contrast effect, high response speed, low cost and other advantages. However threshold voltage drift may arise as a result of non-uniformity and instability of a Thin Film Transistor (TFT) back panel in a process flow.

FIG. 1 illustrates an existing pixel circuit including a transistor T1, a transistor T2, a transistor T3, a transistor T4, a transistor T5, a storage capacitor C1 and an Organic Light Emitting Diode (OLED), and FIG. 2 illustrates a timing diagram of the circuit in operation.

When a scan signal Scan (n−1) of the (n−1)-th row is at a low level and a scan signal Scan (n) of the n-th row is at a high level, the transistor T1 and the transistor T4 are turned off, and the transistor T5 are turned on, so the transistor T2 and the transistor T3 with the mirror structure, are also turned off, so that a signal stored on the storage capacitor C1 is initialized by the transistor T5 using an initial voltage signal Vinit. When the scan signal Scan (n−1) of the (n−1)-th row is at a high level and a scan signal Scan (n) of the n-th row is at a low level, the transistor T1 and the transistor T4 are turned on, and the transistor T5 is turned off, so the transistor T2 and the transistor T3 with the mirror structure, are also turned on, so that an image data signal Data is transmitted to a gate of the transistor T2 through the transistor T1 and the transistor T3, and at this time the transistor T4 is turned on, so drive current, dependent upon the signal loaded to the gate of the transistor T2, flows through the OLED to drive it to emit light. The voltage of the signal loaded to the transistor T2 is Vdata+Vth3, where Vdata is the voltage of the image data signal Data, and Vth3 is the threshold voltage of the transistor T3, and the drive current flowing through the OLED is Ioled=(k/2)(Vdata−Vdd+Vth3−Vth2)2, where k is a constant, Vdd is the voltage of a high-level signal VDD, and Vth2 is the threshold voltage of the transistor T2.

Although the transistor T2 and the transistor T3, which constitute a current mirror, are arranged adjacent to each other on a substrate, it may be difficult to make their threshold voltage same due to a TFT parameter in a fabrication process, and it may be difficult to make the drive current same when the same image data signal is received due to the threshold voltage drift of either of the transistors, which may degrade a display quality.

In summary in the existing organic light emitting diode pixel circuit, it may be difficult to make the threshold voltage of two TFTs consisting a current mirror substantially the same, so it may be difficult to make the drive current substantially the same when the same image data signal is received due to the threshold voltage drift of either of the transistors, which may degrade a display quality.

BRIEF SUMMARY OF THE INVENTION

One inventive aspect is an organic light emitting diode pixel driving circuit, including an external circuit, and a number m of intra-pixel circuits. Each of the intra-pixel circuits includes a signal loading module, a driving transistor and an organic light emitting diode, and a plurality of pixel elements, and respective ones of the m intra-pixel circuits are connected with a same data line. In addition, m is greater than or equal to 2 and is less than or equal to a total number of pixel elements connected with the same data line. Furthermore, a first terminal of the external circuit is configured to receive an image data signal, and a second terminal of the external circuit is connected with sources of the driving transistors of the respective intra-pixel circuits. For each of the signal loading modules, a first terminal of the signal loading module receives a first power supply signal, a second terminal of the signal loading module is connected with the source of the driving transistor of the intra-pixel circuit including the signal loading module, a third terminal of the signal loading module is connected with a gate of the driving transistor, a fourth terminal of the signal loading module is connected with a drain of the driving transistor, a fifth terminal of the signal loading module is connected with the organic light emitting diode of the intra-pixel circuit including the signal loading module, and the organic light emitting diode receives a second power supply signal. Each of the signal loading modules is configured to have its first terminal disconnected from its second terminal during a signal loading phase, to have its third terminal connected with its fourth terminal during the signal loading phase to thereby generate a drive signal from the image data signal received by the second terminal of the signal loading module and to store the drive signal, to have its third terminal disconnected from its fourth terminal during a light emitting phase, to have its fourth terminal disconnected from its fifth terminal during the signal loading phase, and to have its fourth terminal connected with its fifth terminal, to have its first terminal connected with its second terminal, and to control the driving transistor by the drive signal stored during the signal loading phase and a signal at the source of the driving transistor so as to drive the organic light emitting diode of the intra-pixel circuit including the signal loading module to emit light during the light emitting phase. In addition, the external circuit is configured to have its first terminal connected with its second terminal during the signal loading phase, and to have its first terminal disconnected from its second terminal during the light emitting phase.

Another inventive aspect is an organic light emitting diode pixel driving circuit, including an external circuit, a number m of intra-pixel circuits, and a plurality of pixel elements located near respective ones of the m intra-pixel circuits. The pixel elements are connected with a same data line, where m is greater than or equal to 2 and less than or equal to a total number of pixel elements connected with the same data line. The external circuit includes a first switch transistor, which includes a first pole which receives an image data signal, and a gate which receives a first scan signal. Each of the intra-pixel circuits includes a second switch transistor, a third switch transistor, a fourth switch transistor, a driving transistor, and a first capacitor and an organic light emitting diode. The second switch transistor includes a first pole which receives a first power supply signal, and a gate which receives a first light emitting control signal. The first capacitor includes one pole plate which receives the first power supply signal, and another pole plate which is connected with a gate of the driving transistor and a first pole of the fourth switch transistor. The driving transistor includes a source which is connected with a second pole of the first switch transistor and a second pole of the second switch transistor, and a drain which is connected with a first pole of the third switch transistor and a second pole of the fourth switch transistor. The third switch transistor includes a gate which receives a second light emitting control signal, and a second pole which is connected with an anode of an organic light emitting diode, the fourth switch transistor includes a gate which receives a second scan signal. The organic light emitting diode includes a cathode which receives a second power supply signal.

DETAILED DESCRIPTION OF THE PREFERRED EMBODIMENTS

Implementations of an organic light emitting diode pixel driving circuit and a display device according to embodiments of the invention will be described below with reference to the drawings.

Figure 1:
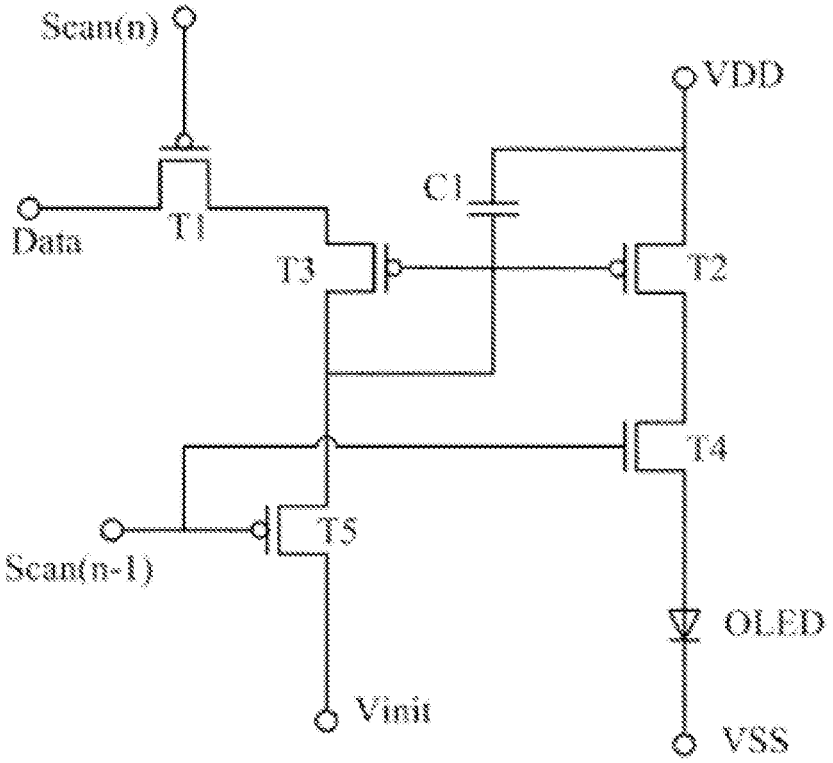
Prior Art Fig.1
FIG. 1 is a schematic structural diagram of a pixel circuit in the prior art.
Figure 2:
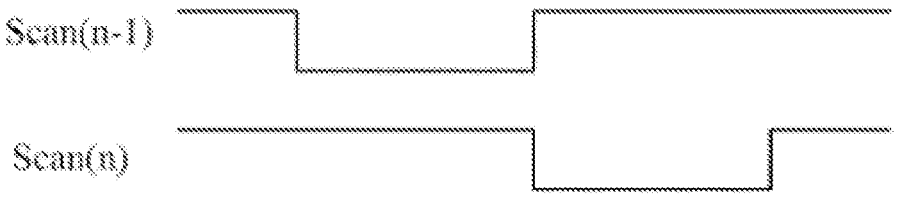
FIG. 2 is a timing diagram of the circuit illustrated in FIG. 1 in operation.
Figure 3:
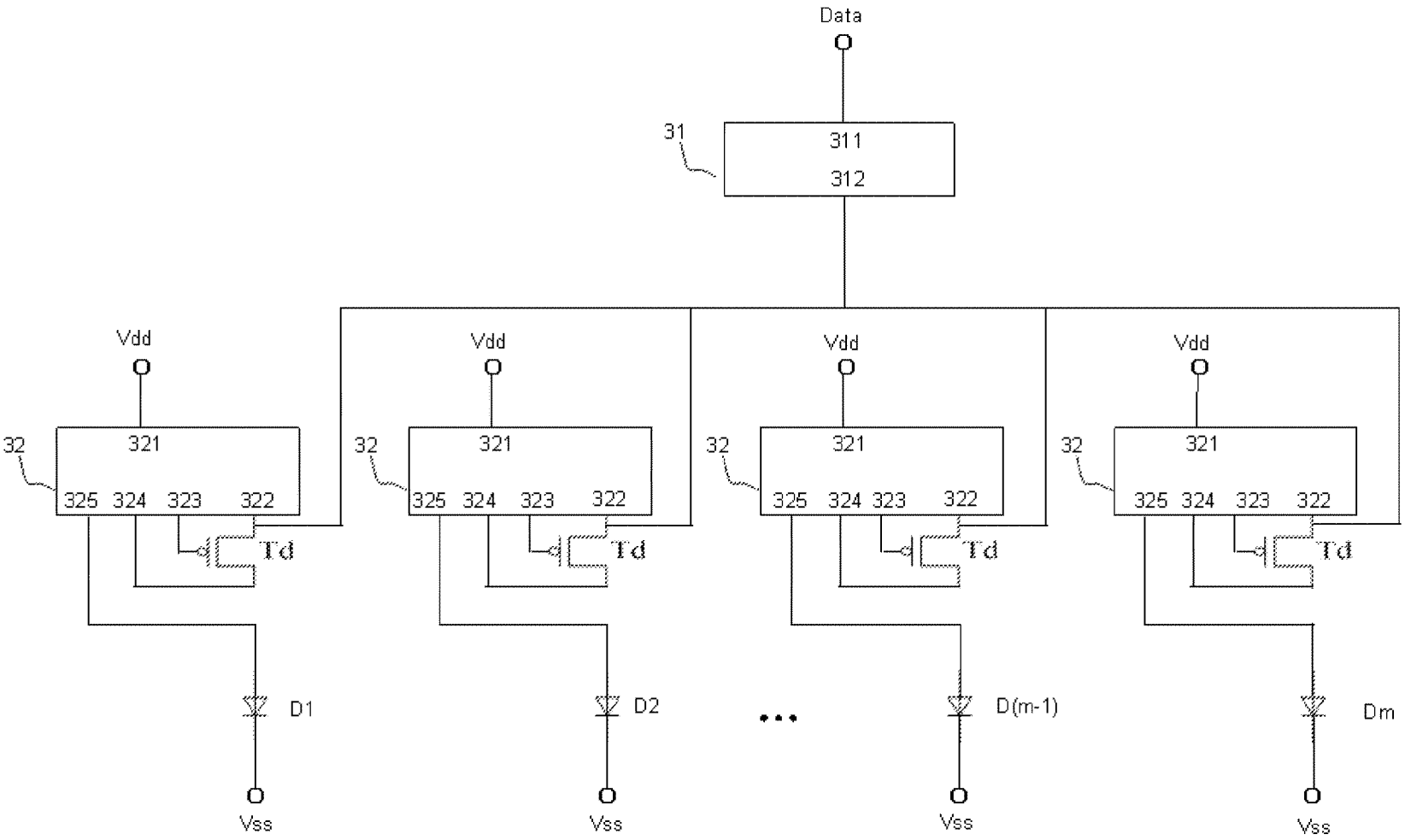
FIG. 3 is a schematic structural diagram of an organic light emitting diode pixel driving circuit according to a first embodiment of the invention.

FIG. 3 illustrates an organic light emitting diode pixel driving circuit according to a first embodiment of the invention, which includes an external circuit 31 and a number m of intra-pixel circuits, each of the intra-pixel circuits is located inside one of pixel elements and the m intra-pixel circuits are connected with the same data line, where m is larger than or equal to 2 and smaller than or equal to a total number of pixel elements connected with the same data line. Each of the intra-pixel circuits includes a signal loading module 32, a driving transistor Td and an organic light emitting diode, and as illustrated in FIG. 3, a number m of organic light emitting diodes D1, D2, . . . , D(m−1) and Dm are respectively included in the m intra-pixel circuits.

A first terminal 311 of the external circuit 31 receives an image data signal Data, and a second terminal 312 of the external circuit 31 is connected respectively with sources of the driving transistors Td in the respective intra-pixel circuits;

A first terminal 321 of each of the signal loading modules 32 receives a first power supply signal Vdd, a second terminal 322 of the signal loading module 32 is connected with a source of the driving transistor Td in the intra-pixel circuit including the signal loading module 32, a third terminal 323 of the signal loading module 32 is connected with a gate of the driving transistor Td, a fourth terminal 324 of the signal loading module 32 is connected with a drain of the driving transistor Td, a fifth terminal 325 of the signal loading module 32 is connected with an anode of the organic light emitting diode in the intra-pixel circuit including the signal loading module 32, and a cathode of the organic light emitting diode receives a second power supply signal Vss;

Each of the signal loading modules 32 is configured to have the first terminal 321 of the signal loading module 32 disconnected from the second terminal 322 of the signal loading module 32 in a signal loading phase; to have the third terminal 323 of the signal loading module 32 connected with the fourth terminal 324 of the signal loading module 32 in the signal loading phase to thereby generate a drive signal from the image data signal received by the second terminal 322 of the signal loading module 32 and store the drive signal; to have the third terminal 323 of the signal loading module 32 disconnected from the fourth terminal 324 of the signal loading module 32 in a light emitting phase; to have the fourth terminal 324 of the signal loading module 32 disconnected from the fifth terminal 325 of the signal loading module 32 in the signal loading phase; and in the light emitting phase, to have the fourth terminal 324 of the signal loading module 32 connected with the fifth terminal 325 of the signal loading module 32, to have the first terminal 321 of the signal loading module 32 connected with the second terminal 322 of the signal loading module 32, and to control the driving transistor Td, by the drive signal stored in the signal loading phase and a signal at the source of the driving transistor Td, to drive the organic light emitting diode in the intra-pixel circuit including the signal loading module to emit light; and The external circuit 31 is configured to have the first terminal 311 of the external circuit 31 connected with the second terminal 312 of the external circuit 31 in the signal loading phase, and to have the first terminal 311 of the external circuit 31 disconnected from the second terminal 312 of the external circuit 31 in the light emitting phase.

An operation principle of the organic light emitting diode pixel driving circuit will be described below with reference to FIG. 4, which only illustrates two intra-pixel circuits as an example, and an operation principle of the m intra-pixel circuits will be the same as the operation principle of the two intra-pixel circuits.

Figure 4:
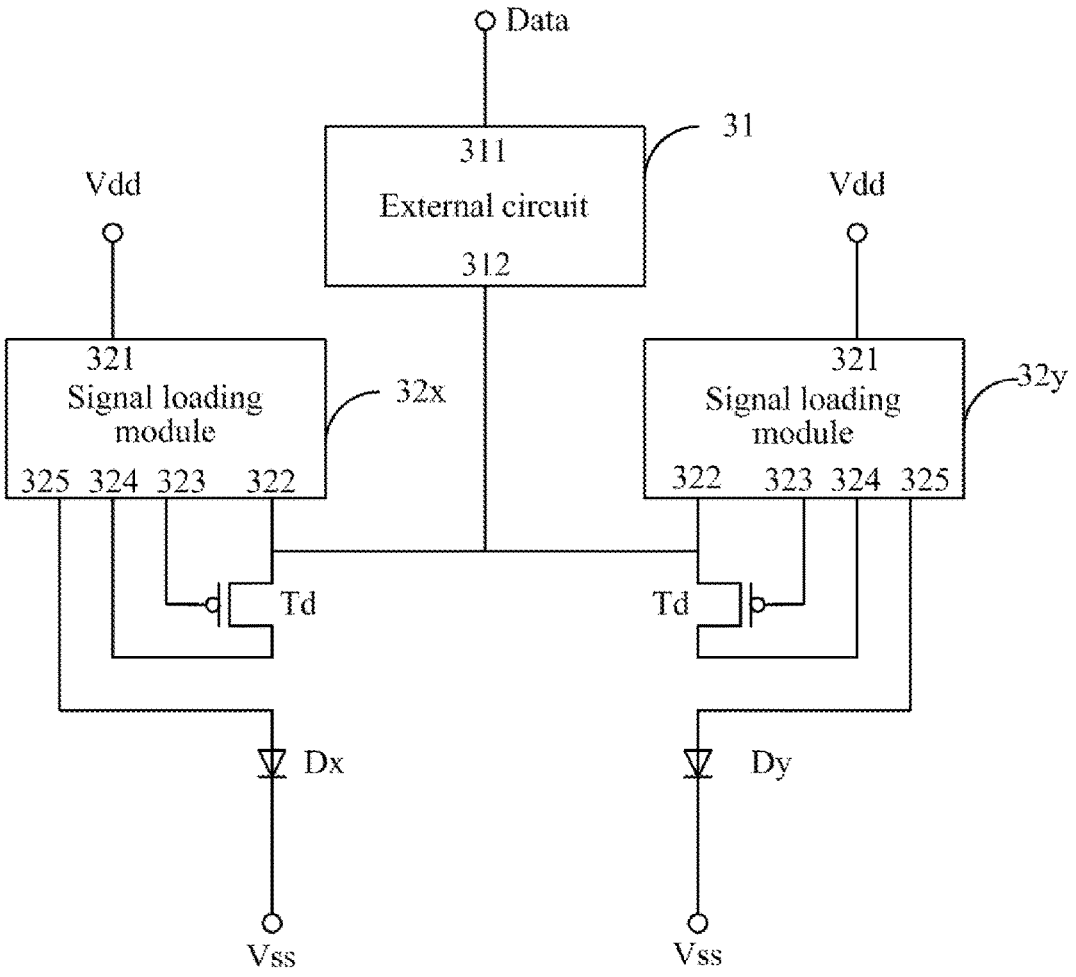
FIG. 4 is a schematic structural diagram of the organic light emitting diode pixel driving circuit according to the first embodiment of the invention.

As illustrated in FIG. 4, the organic light emitting diode pixel driving circuit according to the first embodiment of the invention includes a first intra-pixel circuit x and a second intra-pixel circuit y, where the first intra-pixel circuit x and the second intra-pixel circuit y are any two different ones of the m intra-pixel circuits. The first intra-pixel circuit x includes a signal loading module 32*x*, a driving transistor Td and an organic light emitting diode Dx; and the second intra-pixel circuit y includes a signal loading module 32*y*, a driving transistor Td and an organic light emitting diode Dy.

The external circuit 31 can transmit the image data signal Data on the data line to the second terminals 322 of the signal loading modules 32 in the m pixel elements, i.e., the sources of the driving transistors Td in the m pixel elements, in the signal loading phase, so the source voltage of the driving transistor Td in the first intra-pixel circuit x is Vdata(x) and the source voltage of the driving transistor Td in the second intra-pixel circuit y is Vdata(y).

The signal loading module 32*x* of the first intra-pixel circuit x can have the third terminal 323 of the signal loading module 32*x* connected with the fourth terminal 324 of the signal loading module 32*x* in the signal loading phase, that is, have the gate of the driving transistor Td in the first intra-pixel circuit x connected with its drain, so the gate voltage Vg(x) of the driving transistor Td of the first intra-pixel circuit x is the sum of the source voltage Vs(x) thereof and the threshold voltage Vth(x) thereof, that is:

$$Vg(x)=Vs(x)+Vth(x)=V\text{data}(x)+Vth(x) \tag{1-1}$$

That is, the voltage Vg(x) of the drive signal generated and stored by the signal loading module 32*x* of the first intra-pixel circuit x is Vdata(x)+Vth(x).

The signal loading module 32*x* of the first intra-pixel circuit x has the fourth terminal 324 of the signal loading module 32*x* disconnected from the fifth terminal 325 of the signal loading module 32*x* in the signal loading phase so that the first intra-pixel circuit x doesn't emit light in the signal loading phase; and the signal loading module 32*x* of the first intra-pixel circuit x has the fourth terminal 324 of the signal loading module 32*x* connected with the fifth terminal 325 thereof, that is, has the drain of the driving transistor Td connected with the anode of the organic light emitting diode Dx, in the light emitting phase so that the organic light emitting diode Dx can be driven by the drain current of the driving transistor Td to emit light; and the first terminal 321 of the signal loading module 32*x* is connected with the second terminal 322 thereof in the light emitting phase, so the value of the source voltage Vs(x) of the driving transistor Td of the first intra-pixel circuit x is Vdd in the light emitting phase, and thus the drain current I(x) of the driving transistor Td of the first intra-pixel circuit x is:

$$I(x)=\frac{1}{2}k(Vg(x)-Vs(x)-Vth(x))^2=\frac{1}{2}k(Vdata(x)-Vdd)^2 \tag{1-2}$$

As can be apparent from Equation (1-2), the drain current I(x) of the driving transistor Td of the first intra-pixel circuit x is independent from the threshold voltage Vth(x) of the driving transistor Td. Alike the drain current I(y) of the driving transistor Td of the second intra-pixel circuit y is also independent from the threshold voltage Vth(y) of the driving transistor Td of the second intra-pixel circuit y, so the non-uniformity of display due to the threshold voltages of the driving transistors can be eliminated in the organic light emitting diode pixel driving circuit according to the first embodiment of the invention.

The organic light emitting diode pixel driving circuit according to the first embodiment of the invention includes two components, one of which is the external circuit, and the other of which is the intra-pixel circuits, where the external circuit can be shared by the plurality of pixel elements, and each of the intra-pixel circuits is located in one of the pixel elements; and in order to drive one of the pixel elements, the intra-pixel circuit in the pixel element shall operate together with the external circuit shared by the pixel element to drive the pixel element to emit light so as to lower the total number of transistors of pixel driving circuits on a display panel.

It shall be noted that in the organic light emitting diode pixel driving circuit according to the first embodiment of the invention, the external circuit is shared by the m pixel elements, and in the signal loading phase, the image signal voltage Data thereof is loaded respectively to the respective intra-pixel circuits, and the image data signal Data loaded to the different intra-pixel circuits corresponds respectively to the m intra-pixel circuits. Particularly the third terminal 323 of the signal loading module 32 of the first intra-pixel circuit is connected with the fourth terminal 324 thereof, the image data signal Data1 is loaded to the source of the driving transistor Td of the first intra-pixel circuit, the signal loading module 32 of the first intra-pixel circuit generates and stores the voltage of the drive signal, and the third terminal 323 of the signal loading module 32 of the first intra-pixel circuit is disconnected from the fourth terminal 324 thereof; the third terminal 323 of the signal loading module 32 of the second intra-pixel circuit is connected with the fourth terminal 324 thereof, the image data signal Data2 is loaded to the source of the driving transistor Td of the second intra-pixel circuit, the signal loading module 32 of the second intra-pixel circuit generates and stores the voltage of the drive signal, and the third terminal 323 of the signal loading module 32 of the second intra-pixel circuit is disconnected from the fourth terminal 324 thereof; . . . ; the third terminal 323 of the signal loading module 32 of the (m−1)-th intra-pixel circuit is connected with the fourth terminal 324 thereof, the image data signal Data(m−1) is loaded to the source of the driving transistor Td of the (m−1)-th intra-pixel circuit, the signal loading module 32 of the (m−1)-th intra-pixel circuit generates and stores the voltage of the drive signal, and the third terminal 323 of the signal loading module 32 of the (m−1)-th intra-pixel circuit is disconnected from the fourth terminal 324 thereof and the third terminal 323 of the signal loading module 32 of the m-th intra-pixel circuit is connected with the fourth terminal 324 thereof, the image data signal Datam is loaded to the source of the driving transistor Td of the m-th intra-pixel circuit, the signal loading module 32 of the m-th intra-pixel circuit generates and stores the voltage of the drive signal, and the third terminal 323 of the signal loading module 32 of the m-th intra-pixel circuit is disconnected from the fourth terminal 324 thereof.

In the circuit illustrated in FIG. 4, for example, the organic light emitting diode Dx is located in the first intra-pixel circuit x, and the organic light emitting diode Dy is located in the second intra-pixel circuit y; and firstly the image data signal Data(x) is loaded to the source of the driving transistor Td of the first intra-pixel circuit x, and the third terminal 323 of the signal loading module 32*x* is connected with the fourth terminal 324 of the signal loading module, so that the drive signal is generated from the image data signal Data(x) of the source of the driving transistor Td of the first intra-pixel circuit x, stored and loaded to the gate of the driving transistor Td; and after the drive signal is generated and stored, the third terminal 323 is disconnected from the fourth terminal 324 of the signal loading module 32*x* of the first intra-pixel circuit x, and at this time, no drive signal will be generated at the gate of the driving transistor Td of the first intra-pixel circuit x regardless of the image data signal received at the source thereof.

In the organic light emitting diode pixel driving circuit according to the first embodiment of the invention, the drain current I of each of the m driving transistors Td is independent from the threshold voltage Vth of the driving transistor Td, so the non-uniformity of display due to the different threshold voltages of the plurality of driving transistors can be eliminated to thereby provide a better display effect in the organic light emitting diode pixel driving circuit according to the first embodiment of the invention.

The organic light emitting diode pixel driving circuit according to the first embodiment of the invention includes two components, one of which is the external circuit, and the other of which is the intra-pixel circuits, where the external circuit can be shared by the m pixel elements, and each of the intra-pixel circuits is located in one of the pixel elements; and in order to drive one of the pixel elements, the intra-pixel circuit in the pixel element shall operate together with the external circuit shared by the pixel element to drive the pixel element to emit light. With the organic light emitting diode pixel driving circuit according to the first embodiment of the invention, the number of devices in the pixel elements can be lowered and the size of the pixel elements can be shrunk to thereby make it particularly suitable for display panel with a high-resolution. Furthermore the total number of devices in pixel driving circuits on the display panel can be lowered and the size of the display panel can be lowered to thereby further minimize a display device.

Figure 5:
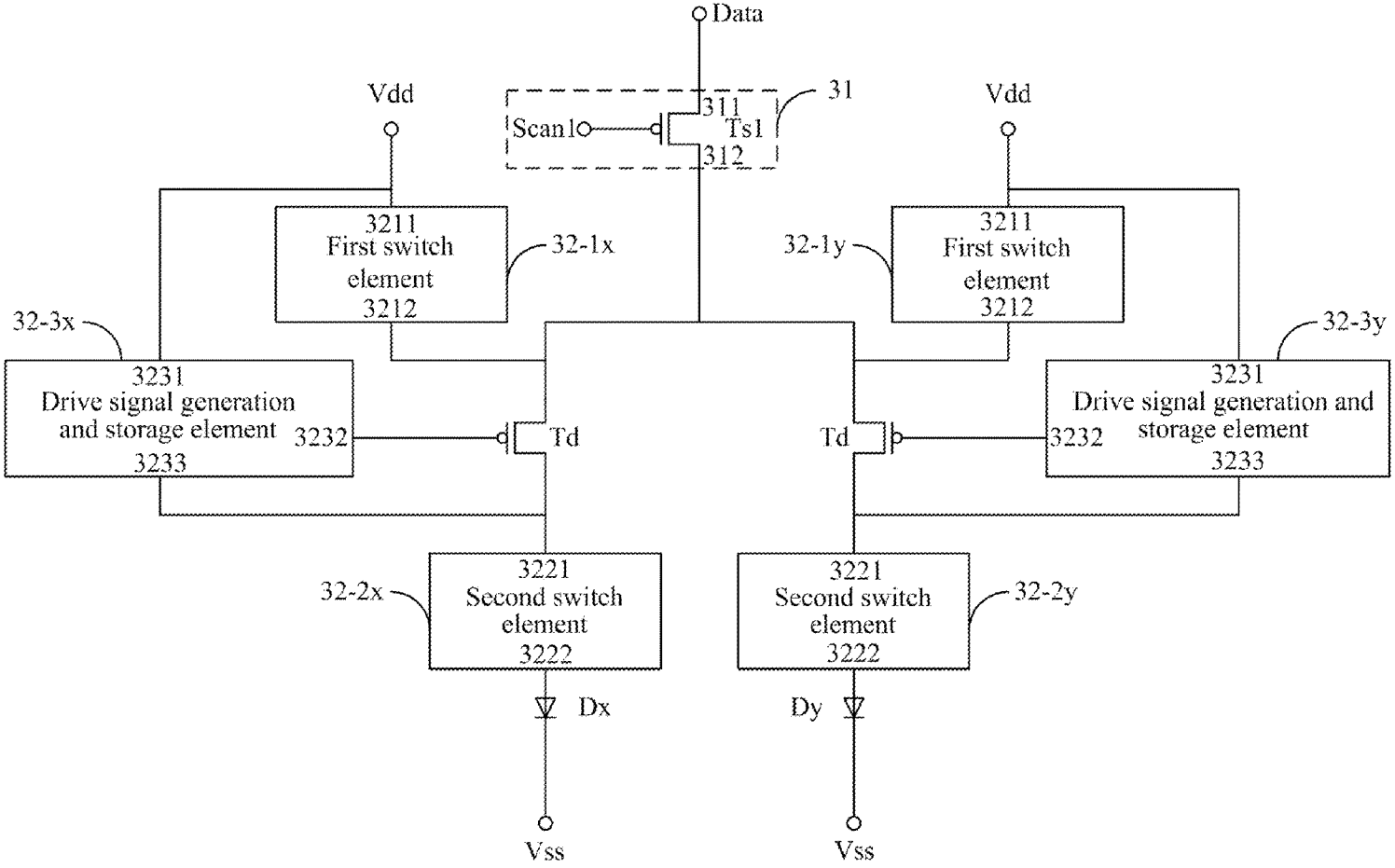
FIG. 5 is a schematic structural diagram of an organic light emitting diode pixel driving circuit according to a second embodiment of the invention.

FIG. 5 illustrates an organic light emitting diode pixel driving circuit according to a second embodiment of the invention, which includes an external circuit and a number m of intra-pixel circuits, each of intra-pixel circuits is located inside one of pixel elements and connected with the same data line, where m is larger than or equal to 2 and smaller than or equal to the total number of pixel elements connected with the same data line; and each of the intra-pixel circuits includes a signal loading module, a driving transistor Td and an organic light emitting diode. The external circuit includes a first switch transistor, and the signal loading module includes a first switch element, a second switch element and a drive signal generation and storage element.

As illustrated in FIG. 5, the external circuit 31 includes the first switch transistor Ts1, where a first pole of the first switch transistor Ts1 is a first terminal 311 of the external circuit 31, a gate of the first switch transistor Ts1 receives a first scan signal Scan1, and a second pole of the first switch transistor Ts1 is a second terminal 312 of the external circuit 31; and the first switch transistor Ts1 is configured to be turned on in a signal loading phase and to be turned off in a light emitting phase.

As illustrated in FIG. 5, the organic light emitting diode pixel driving circuit according to the second embodiment of the invention includes two intra-pixel circuits which are any two different ones of the m intra-pixel circuits.

Each of the signal loading modules 32 includes the first switch element 32-1, the second switch element 32-2 and the drive signal generation and storage element 32-3, where a first terminal 3211 of the first switch element 32-1 is a first terminal of the signal loading module 32, and a second terminal 3212 of the first switch element 32-1 is a second terminal of the signal loading module 32; a first terminal 3221 of the second switch element 32-2 is a fourth terminal of the signal loading module 32, and a second terminal 3222 of the second switch element 32-2 is a fifth terminal of the signal loading module 32; and a first terminal 3231 of the drive signal generation and storage element 32-3 is the first terminal of the signal loading module 32, a second terminal 3232 of the drive signal generation and storage element 32-3 is a third terminal of the signal loading module 32, and a third terminal 3233 of the drive signal generation and storage element 32-3 is the fourth terminal of the signal loading module 32;

Both the first switch element 32-1 and the second switch element 32-2 are configured to be turned off in the signal loading phase and to be turned on in the light emitting phase; and The drive signal generation and storage element 32-3 is configured to have the second terminal 3232 of the drive signal generation and storage element 32-3 connected with the third terminal 3233 of the drive signal generation and storage element 32-3 when a gate line, connected with the pixel element where the intra-pixel circuit including the signal loading module is located, is enabled in the signal loading phase, to thereby generate a drive signal from an image data signal Data at a source of the driving transistor Td in the intra-pixel circuit including the drive signal generation and storage element 32-3 and store the drive signal; to have the second terminal 3232 of the drive signal generation and storage element 32-3 disconnected from the third terminal 3233 of the drive signal generation and storage element 32-3 in the remaining period of the signal loading phase and the light emitting phase; and to control the driving transistor by the drive signal stored in the signal loading phase and the signal at the source of the driving transistor Td to drive the organic light emitting diode in the intra-pixel circuit including the signal loading module 32 to emit light in the light emitting phase.

Figure 6:
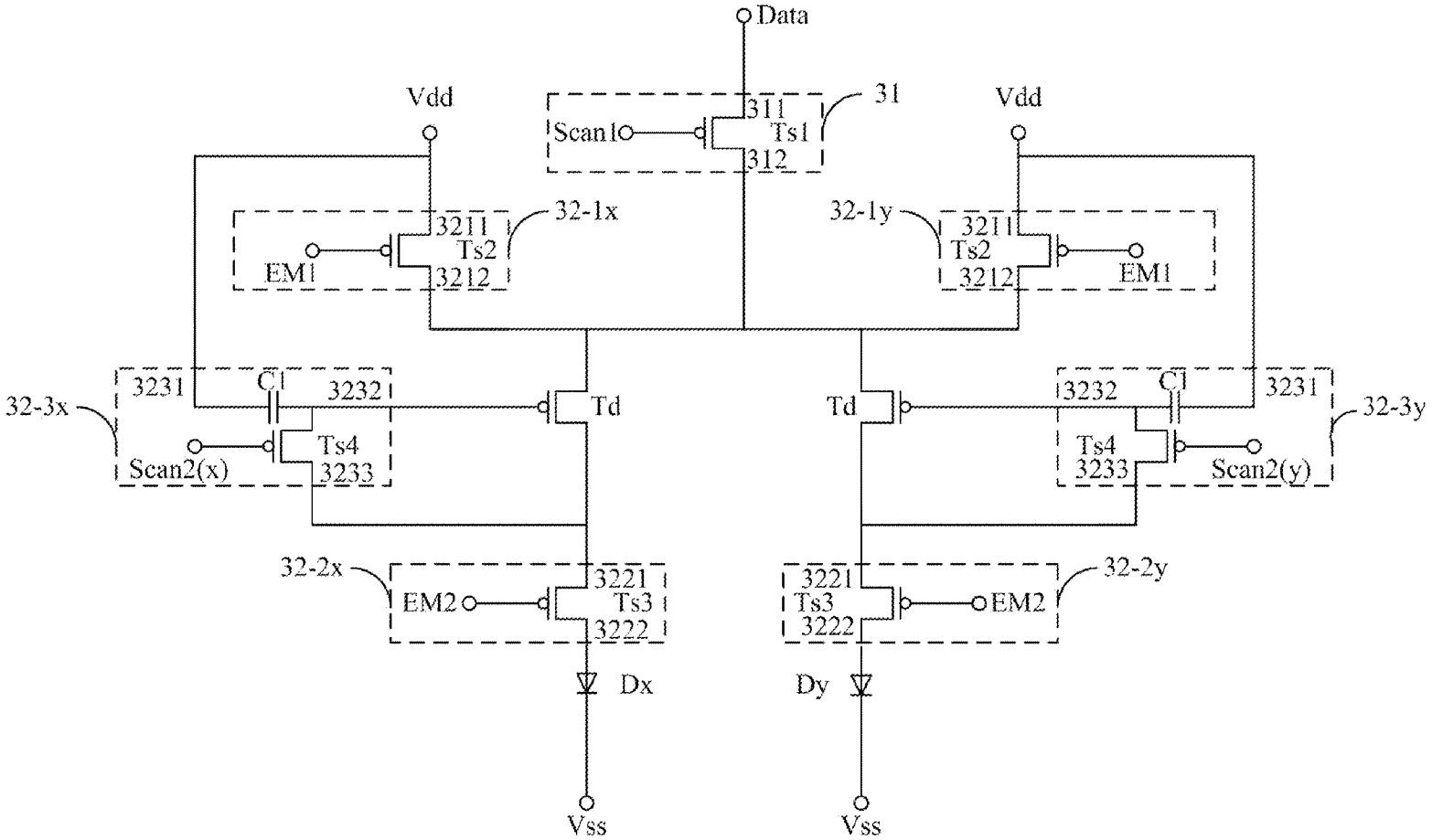
FIG. 6 is a schematic structural diagram of an organic light emitting diode pixel driving circuit according to a third embodiment of the invention.

FIG. 6 illustrates an organic light emitting diode pixel driving circuit according to a third embodiment of the invention, which includes an external circuit and a number m of intra-pixel circuits, each of intra-pixel circuits is located inside one of pixel elements and connected with the same data line, where m is larger than or equal to 2 and smaller than or equal to the total number of pixel elements connected with the same data line; and each of the intra-pixel circuits includes a signal loading module, a driving transistor Td and an organic light emitting diode. The external circuit includes a first switch transistor. The signal loading module includes a first switch element, a second switch element and a drive signal generation and storage element. The first switch element includes a second switch transistor, the second switch element includes a third switch transistor, and the drive signal generation and storage element includes a fourth switch transistor and a first capacitor.

The external circuit 31 includes the first switch transistor Ts1, where a first pole of the first switch transistor Ts1 is a first terminal 311 of the external circuit 31, a gate of the first switch transistor Ts1 receives a first scan signal Scan1, and a second pole of the first switch transistor Ts1 is a second terminal 312 of the external circuit 31; and the first switch transistor Ts1 is configured to be turned on in a signal loading phase and to be turned off in a light emitting phase.

FIG. 6 illustrates an organic light emitting diode pixel driving circuit according to the third embodiment of the invention, in which only two intra-pixel circuits, including a first intra-pixel circuit x and a second intra-pixel circuit y, are shown. Where the first intra-pixel circuit x and the second intra-pixel circuit y are any two different ones of the m intra-pixel circuits, and an operation principle of the m intra-pixel circuits will be the same as an operation principle of the two intra-pixel circuits.

Each of the first switch elements (there are only a first switch element 32-1*x* and a first switch element 32-1*y* illustrated in FIG. 6) includes the second switch transistor Ts2, where a first pole of the second switch transistor Ts2 is a first terminal 3211 of the first switch element 32-1, a gate of the second switch transistor Ts2 receives a first light emitting control signal EM1, and a second pole of the second switch transistor Ts2 is a second terminal 3212 of the first switch element 32-1; and the second switch transistor Ts2 is configured to be turned off in the signal loading phase and to be turned on in the light emitting phase to thereby load a first power supply signal Vdd to a source of the driving transistor Td.

Each of the second switch elements (there are only a second switch element 32-2*x* and a second switch element 32-2*y* illustrated in FIG. 6) includes a third switch transistor Ts3, where a first pole of the third switch transistor Ts3 is a first terminal 3221 of the second switch element 32-2, a gate of the third switch transistor Ts3 receives a second light emitting control signal EM2, and a second pole of the third switch transistor Ts3 is a second terminal 3222 of the second switch element 32-2; and the third switch transistor Ts3 is configured to be turned off in the signal loading phase and to be turned on in the light emitting phase to thereby connect a drain of the driving transistor Td with an anode of the organic light emitting diode.

Each of the drive signal generation and storage elements (there are only a drive signal generation and storage element 32-3*x* and a drive signal generation and storage element 32-3*y* illustrated in FIG. 6) includes a fourth switch transistor Ts4 and a first capacitor C1.

In the drive signal generation and storage element 32-3*x* of the first intra-pixel circuit x, a first terminal of the first capacitor C1 is a first terminal 3231 of the drive signal generation and storage element 32-3*x*, and a second terminal of the first capacitor C1 is a second terminal 3232 of the drive signal generation and storage element 32-3*x*; a first pole of the fourth switch transistor Ts4 is the second terminal 3232 of the drive signal generation and storage element 32-3*x*, a gate of the fourth switch transistor Ts4 receives a second scan signal Scan2(*x*), and a second pole of the fourth switch transistor Ts4 is a third terminal 3233 of the drive signal generation and storage element 32-3*x*; the fourth switch transistor Ts4 is configured to be turned on in the signal loading phase to thereby connect a gate with the drain of the driving transistor Td of the first intra-pixel circuit x and to be turned off in the light emitting phase; and the first capacitor C1 is configured to store a drive signal generated in the signal loading phase.

Alike in the drive signal generation and storage element 32-3*y* of the second intra-pixel circuit y, a first terminal of the first capacitor C1 is a first terminal 3231 of the drive signal generation and storage element 32-3*y*, and a second terminal of the first capacitor C1 is a second terminal 3232 of the drive signal generation and storage element 32-3*y*; a first pole of the fourth switch transistor Ts4 is the second terminal 3232 of the drive signal generation and storage element 32-3*y*, a gate of the fourth switch transistor Ts4 receives a second scan signal Scan2(*y*), and a second pole of the fourth switch transistor Ts4 is a third terminal 3233 of the drive signal generation and storage element 32-3*y*; the fourth switch transistor Ts4 is configured to be turned on in the signal loading phase to thereby connect a gate with the drain of the driving transistor Td of the second intra-pixel circuit y and to be turned off in the light emitting phase; and the first capacitor C1 is configured to store a drive signal generated in the signal loading phase.

Figure 7:
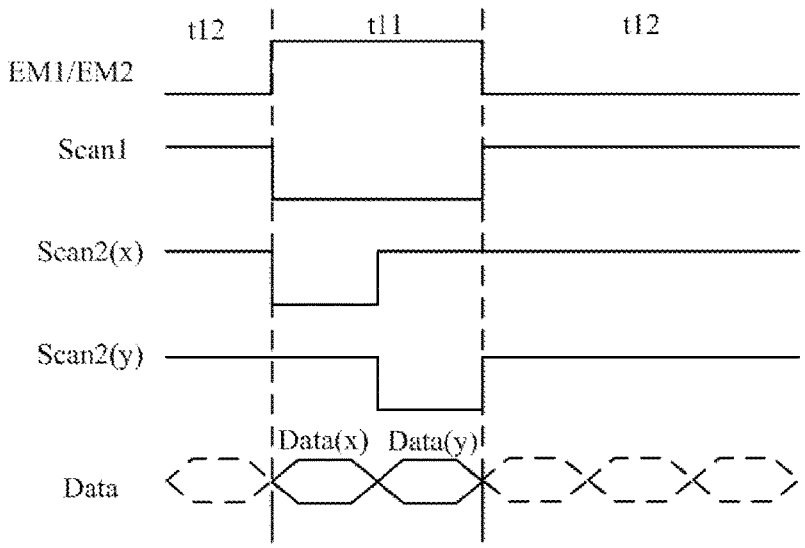
FIG. 7 is a first timing diagram of the organic light emitting diode pixel driving circuit according to the third embodiment of the invention in operation.

FIG. 7 illustrates a timing diagram of the organic light emitting diode pixel driving circuit according to the third embodiment of the invention in operation, where the first light emitting control signal EM1 is the same as the second light emitting control signal EM2, and the timing in operation includes two phases: the signal loading phase t11 and the light emitting phase t12.

In the signal loading phase t11, the first light emitting control signal EM1 and the second light emitting control signal EM2 at a high level are provided as disabling signals, and the first scan signal Scan1 at a low level is provided as an enabling signal, so both the second switch transistor Ts2 and the third switch transistor Ts3 are turned off, and the first switch transistor Ts1 is turned on, so that an image data signal Data is loaded sequentially to the sources of the driving transistors Td in the pixel elements sharing the external circuit. Moreover in the signal loading phase t11, the second scan signals Scan2*x* and Scan2*y* are provided sequentially as enabling signals, and the fourth switch transistor Ts4 in the first intra-pixel circuit x and the fourth switch transistor Ts4 in the second intra-pixel circuit y are turned on sequentially.

In the circuit illustrated in FIG. 6, firstly in the first intra-pixel circuit x, the image data signal Data(x) is loaded to the source of the driving transistor, and the fourth switch transistor Ts4 is turned on, so the gate of the driving transistor Td of the first intra-pixel circuit x is connected with the drain of the driving transistor Td, and the value of the gate voltage Vg(x) of the driving transistor Td is the sum of the source voltage Vs(x) thereof and the threshold voltage Vth(x) thereof, and the gate voltage Vg(x) of the driving transistor Td of the first intra-pixel circuit x is:

$$Vg(x)=Vs(x)+Vth(x)=V\text{data}(x)+Vth(x) \quad (1\text{-}1)$$

That is, the voltage of the drive signal stored in the first capacitor C1 of the first intra-pixel circuit x is Vdata(x)+Vth(x).

Next the image data signal Data(y) is loaded to the source of the driving transistor of the second intra-pixel circuit y, and alike the gate voltage Vg(y) of the driving transistor Td of the second intra-pixel circuit y is:

$$Vg(y)=Vs(y)+Vth(y)=V\text{data}(y)+Vth(y) \quad (2\text{-}1)$$

Where Vs(y) is the source voltage of the driving transistor of the second intra-pixel circuit y, and V(th) is the threshold voltage of the driving transistor of the second intra-pixel circuit y. That is, the voltage of the drive signal stored in the first capacitor C1 of the second intra-pixel circuit y is Vdata(y)+Vth(y).

In the light emitting phase t12, the first light emitting control signal EM1 and the second light emitting control signal EM2 at a low level are provided as enabling signals, the first scan signal Scan1 at a high level is provided as a disabling signal, and the second scan signal Scan2 at a high level is provided as a disabling signal, so both the second switch transistor Ts2 and the third switch transistor Ts3 are turned on, and both the first switch transistor Ts1 and the fourth switch transistor Ts4 are turned off.

In the circuit illustrated in FIG. 6, in the first intra-pixel circuit x, both the second switch transistor Ts2 and the third switch transistor Ts3 are turned on, and both the first switch transistor Ts1 and the fourth switch transistor Ts4 are turned off; and as per the equation of a current characteristic of a transistor operating in a saturation region, the drain current of the driving transistor Td of the first intra-pixel circuit x is:

$$I(x) = \frac{1}{2}k(Vg(x) - Vs(x) - Vth(x))^2 = \frac{1}{2}k(Vdata(x) - Vdd)^2 \quad (1\text{-}2)$$

As can be apparent from Equation of (1-2), the drain current I(x) of the driving transistor Td of the first intra-pixel circuit x is independent from the threshold voltage Vth(x) thereof.

Alike in the second intra-pixel circuit y, both the second switch transistor Ts2 and the third switch transistor Ts3 are turned on, and both the first switch transistor Ts1 and the fourth switch transistor Ts4 are turned off; and as per the equation of a current characteristic of a transistor operating in a saturation region, the drain current of the driving transistor Td of the second intra-pixel circuit y is:

$$I(y) = \frac{1}{2}k(Vg(y) - Vs(y) - Vth(y))^2 = \frac{1}{2}k(Vdata(y) - Vdd)^2 \quad (2\text{-}2)$$

As can be apparent from Equation of (2-2), the drain current I(y) of the driving transistor Td of the second intra-pixel circuit y is also independent from the threshold voltage Vth(y) thereof, so the non-uniformity of display due to the threshold voltages of the driving transistors can be eliminated with the organic light emitting diode pixel driving circuit according to the third embodiment of the invention.

The drain current I of each of the m driving transistors Td in the organic light emitting diode pixel driving circuit according to the third embodiment of the invention is indepterminalent from the threshold voltage Vth of the driving transistor Td, so the non-uniformity of display due to the different threshold voltages of the plurality of driving transistors can be eliminated to thereby provide a better display effect in the organic light emitting diode pixel driving circuit according to the third embodiment of the invention.

The organic light emitting diode pixel driving circuit according to the third embodiment of the invention includes two components, one of which is the external circuit, and the other of which is the intra-pixel circuits, where the external circuit can be shared by the m pixel elements, and each of the intra-pixel circuits is located in one of the pixel elements; and in order to drive one of the pixel elements to emit light, the intra-pixel circuit in the pixel element shall operate together with the external circuit shared by the pixel element to drive the pixel element to emit light. With the organic light emitting diode pixel driving circuit according to the third embodiment of the invention, the number of devices in the pixel elements can be lowered and the size of the pixel elements can be shrunk to thereby make it particularly suitable for display panel with a high-resolution. Furthermore the total number of devices in pixel driving circuits on the display panel can be lowered and the size of the display panel can be lowered to thereby further minimize a display device.

Figure 8:
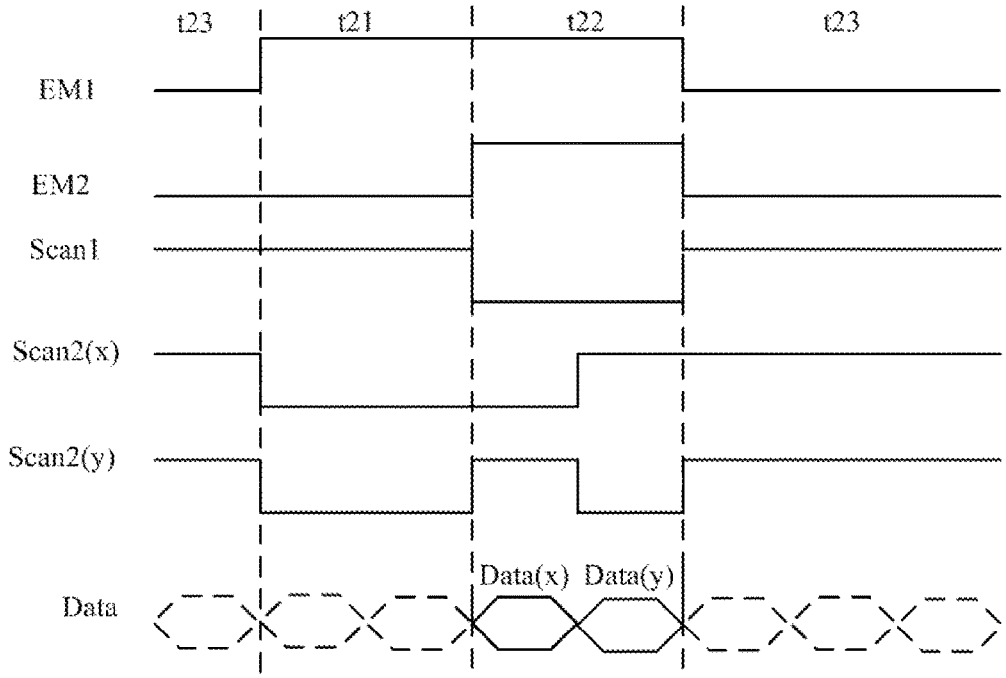
FIG. 8 is a second timing diagram of the organic light emitting diode pixel driving circuit according to the third embodiment of the invention in operation.

Alternatively FIG. 8 illustrates another timing diagram of the organic light emitting diode pixel driving circuit in operation according to the third embodiment of the invention, which includes three phases: an initialization phase t21, the signal loading phase t22 and the light emitting phase t23.

In the initialization phase t21 in FIG. 8, the first scan signal Scan1, received by the gate of the first switch transistor Ts1, is at a high level, so the first switch transistor Ts1 is turned off;

The second scan signal Scan2(*x*) and the second scan signal Scan2(*y*) are at low levels, so both the fourth switch transistor Ts4 in the first intra-pixel circuit x and the fourth switch transistor Ts4 in the second intra-pixel circuit y are turned on;

The second light emitting control EM2 is at a low level, so both the third switch transistor Ts3 of the first intra-pixel circuit x and the third switch transistor Ts3 of the second intra-pixel circuit y are turned on; and The first light emitting control signal EM1 received by the gate of the first switch transistor Ts1 is at a high level, so the first switch transistor Ts1 is turned off.

Both the third switch transistor Ts3 and the fourth switch transistor Ts4 of the first intra-pixel circuit x are turned on, so the gate of the driving transistor Td of the first intra-pixel circuit x receives a second power supply signal Vss, that is, the signal at the gate of the driving transistor Td of the first intra-pixel circuit x is reset to the second power supply signal Vss. Both the third switch transistor Ts3 and the fourth switch transistor Ts4 of the second intra-pixel circuit y are turned on, so the gate of the driving transistor Td of the second intra-pixel circuit y receives the second power supply signal Vss, that is, the signal at the gate of the driving transistor Td of the second intra-pixel circuit y is reset to the second power supply signal Vss. Thus an influence of a signal displayed in a previous frame on the display of a next frame of image can be avoided.

A condition of the organic light emitting diode pixel driving circuit according to the third embodiment of the invention operating in the signal loading phase in FIG. 8 is the same as the condition of the organic light emitting diode pixel driving circuit according to the third embodiment of the invention operating in the signal loading phase in FIG. 7, so a repeated description thereof will be omitted here.

A condition of the organic light emitting diode pixel driving circuit according to the third embodiment of the invention operating in the light emitting phase in FIG. 8 will be the same as the condition of the organic light emitting diode pixel driving circuit according to the third embodiment of the invention operating in the light emitting phase in FIG. 7, so a repeated description thereof will be omitted here.

Figure 9:
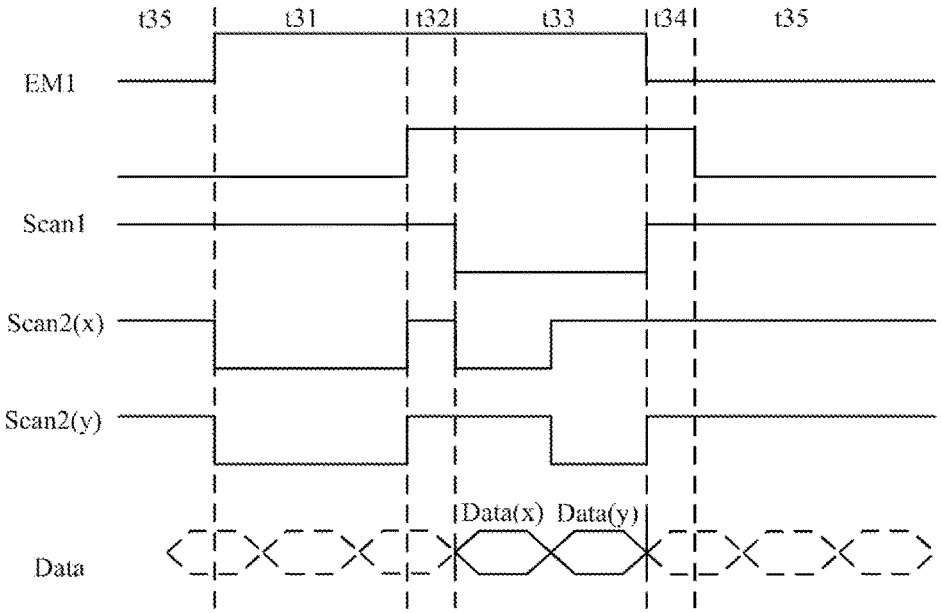
FIG. 9 is a third timing diagram of the organic light emitting diode pixel driving circuit according to the third embodiment of the invention in operation.

Alternatively FIG. 9 illustrates another timing diagram of the organic light emitting diode pixel driving circuit in operation according to the third embodiment of the invention, which includes three phases: an initialization phase t31, a first wait phase t32, the signal loading phase t33, a second wait phase t34 and the light emitting phase t35.

In the initialization phase t31 in FIG. 9, a condition in operation thereof is the same as the condition in operation in the initialization phase in FIG. 8, so a repeated description thereof will be omitted here.

In the first wait phase t32 in FIG. 9, the first scan signal Scan1 received by the gate of the first switch transistor Ts1 is at a high level, so the first switch transistor Ts1 is turned off; the second scan signal Scan2(*x*), received by the gate of the fourth switch transistor Ts4 of the first intra-pixel circuit x, is at a high level, so the fourth switch transistor Ts4 is turned off; the second scan signal Scan2(*y*), received by the gate of the fourth switch transistor Ts4 of the second intra-pixel circuit y, is at a high level, so the fourth switch transistor Ts4 is also turned off; the second light emitting control signal EM2, received by the gate of the third switch transistor Ts3 of the first intra-pixel circuit x and the gate of the third switch transistor Ts3 of the second intra-pixel circuit y, is at a high level, so these two third switch transistors Ts3 are turned off; and the first light emitting control signal EM1, received by the gate of the second switch transistor Ts2 of the first intra-pixel circuit x and the gate of the second switch transistor Ts2 of the second intra-pixel circuit y, is at a high level, so these two second switch transistors Ts2 are turned off. With the first wait phase t32, the signal can be ensured to be loaded after the third switch transistor Ts3 is turned off.

A condition of the organic light emitting diode pixel driving circuit according to the third embodiment of the invention operating in the signal loading phase t33 in FIG. 9 is the same as the condition of the organic light emitting diode pixel driving circuit according to the third embodiment of the invention operating in the signal loading phase in FIG. 7, so a repeated description thereof will be omitted here.

In the second wait phase t34 in FIG. 9, the first scan signal Scan1, received by the gate of the first switch transistor Ts1, is at a high level, so the first switch transistor Ts1 is turned off; the second scan signal Scan2(*x*), received by the gate of the fourth switch transistor Ts4 of the first intra-pixel circuit x, is at a high level, so the fourth switch transistor Ts4 is turned off; the second scan signal Scan2(*y*), received by the gate of the fourth switch transistor Ts4 of the second intra-pixel circuit y, is at a high level, so the fourth switch transistor Ts4 is also turned off; the second light emitting control signal EM2, received by the gate of the third switch transistor Ts3 of the first intra-pixel circuit x and the gate of the third switch transistor Ts3 of the second intra-pixel circuit y, is at a high level, so these two third switch transistors Ts3 are turned off; and the first light emitting control signal EM1, received by the gate of the second switch transistor Ts2 of the first intra-pixel circuit x and the gate of the second switch transistor Ts2 of the second intra-pixel circuit y, is at a low level, so these two second switch transistors Ts2 are turned on. With the second wait phase t34, the pixel element can be ensured to emit light for display after the fourth switch transistor Ts4 is turned off.

A condition of the organic light emitting diode pixel driving circuit according to the third embodiment of the invention operating in the light emitting phase t35 in FIG. 9 is the same as the condition of the organic light emitting diode pixel driving circuit according to the third embodiment of the invention operating in the light emitting phase in FIG. 7, so a repeated description thereof will be omitted here.

An organic light emitting diode pixel driving circuit according to a fourth embodiment of the invention includes an external circuit and a number m of intra-pixel circuits, each of intra-pixel circuits is located inside one of pixel elements and the m intra-pixel circuits are connected with the same data line, where m is larger than or equal to 2 and smaller than or equal to the total number of pixel elements connected with the same data line; and each of the intra-pixel circuits includes a signal loading module, a driving transistor Td and an organic light emitting diode.

Figure 10:
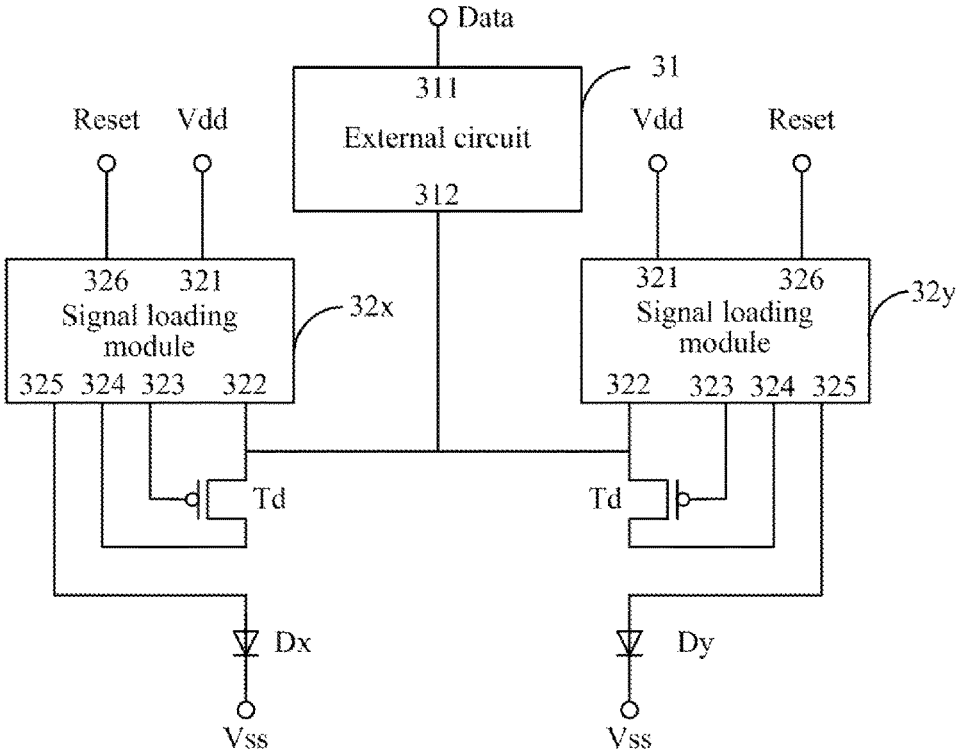
FIG. 10 is a schematic structural diagram of an organic light emitting diode pixel driving circuit according to a fourth embodiment of the invention.

An operation principle of the organic light emitting diode pixel driving circuit will be described in the fourth embodiment below with reference to FIG. 10, which only illustrates two of the intra-pixel circuits as an example, and an operation principle of the m intra-pixel circuits will be the same as the operation principle of the two intra-pixel circuits. As illustrated in FIG. 10, the organic light emitting diode pixel driving circuit according to the fourth embodiment of the invention includes a first intra-pixel circuit x and a second intra-pixel circuit y, where the first intra-pixel circuit x and the second intra-pixel circuit y are any two different ones of the m intra-pixel circuits.

In addition to the functions of the organic light emitting diode pixel driving circuit according to the first embodiment of the invention, each of the signal loading modules 32 of the circuit illustrated in FIG. 10 (there are only a signal loading module 32*x* of the first intra-pixel circuit x and a signal loading module 32*y* of the second intra-pixel circuit y illustrated in FIG. 10) is further configured to transmit a reset signal Reset, received by a sixth terminal 326 of the signal loading module 32, to the third terminal 323 of the signal loading module 32 and to have the first terminal 321 of the signal loading module 32 disconnected from the second terminal 322 of the signal loading module 32 in an initialization phase which precedes the signal loading phase; and to stop transmitting the reset signal Reset in the signal loading phase and the light emitting phase.

The organic light emitting diode pixel driving circuit according to the fourth embodiment of the invention has the functions of the organic light emitting diode pixel driving circuit according to the first embodiment of the invention, so the organic light emitting diode pixel driving circuit according to the fourth embodiment of the invention also operates in the signal loading phase and the light emitting phase, and conditions of the organic light emitting diode pixel driving circuit according to the fourth embodiment of the invention operating in these two phases are the same as the conditions of the organic light emitting diode pixel driving circuit according to the first embodiment of the invention, so a repeated description thereof will be omitted here.

In the organic light emitting diode pixel driving circuit according to the fourth embodiment of the invention, the reset signal Reset received by the sixth terminal 326 of the signal loading module 32 can be transmitted to the third terminal 323 of the signal loading module 32 in the initialization phase, that is, the reset signal Reset can be loaded to the gate of the driving transistor Td in the initialization phase, to thereby eliminate an influence of a signal displayed in a previous frame on the display of a next frame of image.

Figure 11:
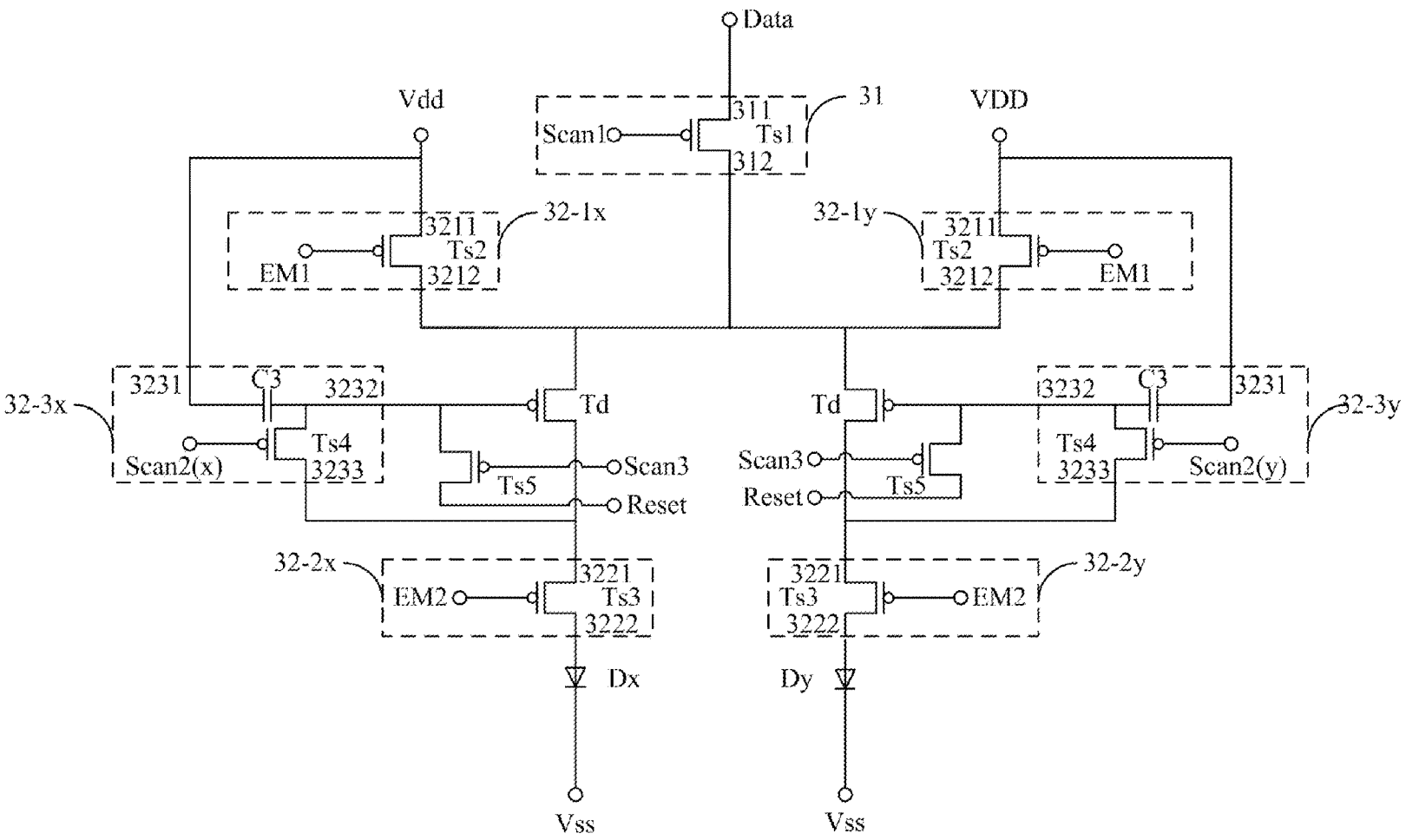
FIG. 11 is a schematic structural diagram of an organic light emitting diode pixel driving circuit according to a fifth embodiment of the invention.

FIG. 11 illustrates an organic light emitting diode pixel driving circuit according to a fifth embodiment of the invention, which includes an external circuit and a number m of intra-pixel circuits, each of intra-pixel circuits is located inside one of pixel elements and the m intra-pixel circuits are connected with the same data line, where m is larger than or equal to 2 and smaller than or equal to the total number of pixel elements connected with the same data line; and each of the intra-pixel circuits includes a signal loading module, a driving transistor Td and an organic light emitting diode. The external circuit includes a first switch transistor. The signal loading module includes a second switch transistor, a third switch transistor, a fourth switch transistor, a fifth switch transistor and a first storage capacitor.

An operation principle of the organic light emitting diode pixel driving circuit will be described in the fifth embodiment below with reference to FIG. 11, which only illustrates two of the intra-pixel circuits as an example, and an operation principle of the m intra-pixel circuits is the same as the operation principle of the two intra-pixel circuits. As illustrated in FIG. 11, the organic light emitting diode pixel driving circuit according to the fifth embodiment of the invention includes a first intra-pixel circuit x and a second intra-pixel circuit y, where the first intra-pixel circuit x and the second intra-pixel circuit y are any two different ones of the m intra-pixel circuits.

In addition to the functions of the organic light emitting diode pixel driving circuit according to the third embodiment of the invention, in the organic light emitting diode pixel driving circuit according to the fifth embodiment of the invention, the signal loading module in each of the intra-pixel circuits in the circuit illustrated in FIG. 11 further includes the fifth switch transistor Ts5, where a first pole of the fifth switch transistor Ts5 is a sixth terminal 326 of the signal loading module 32, a gate of the fifth switch transistor Ts5 receives a third scan signal Scan3, and a second pole of the fifth switch transistor Ts5 is the third terminal 323 of the signal loading module 32; and the fifth switch transistor Ts5 is configured to be turned on in the initialization phase to thereby load the reset signal Reset to the gate of the driving transistor Td, and to be turned off in the signal loading phase and the light emitting phase.

Figure 12:
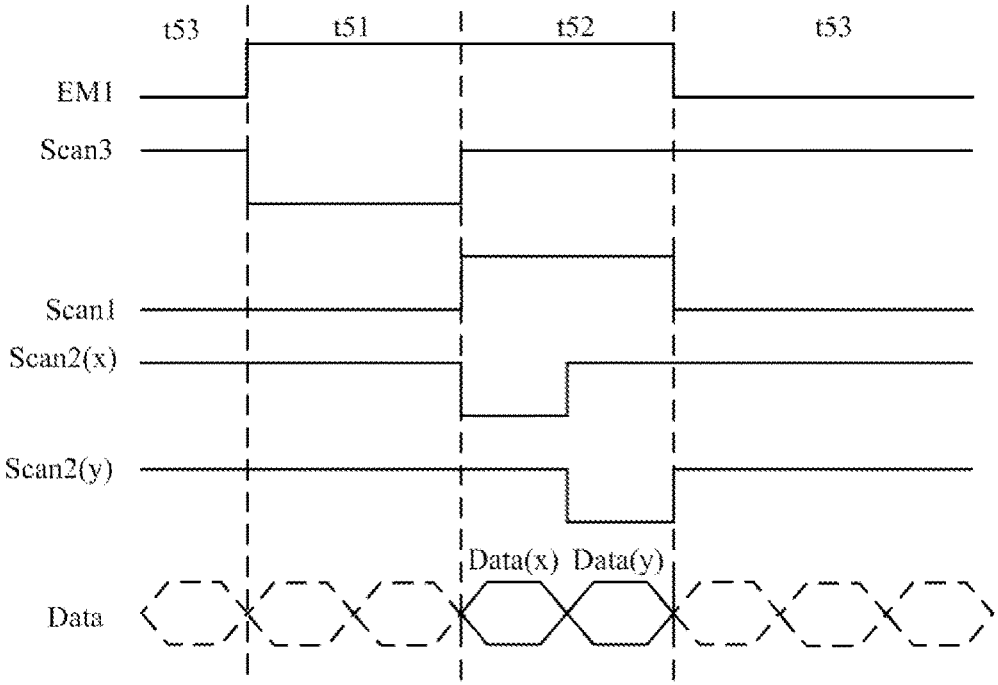
FIG. 12 is a timing diagram of the organic light emitting diode pixel driving circuit according to the fifth embodiment of the invention in operation.

FIG. 12 illustrates a timing diagram of the organic light emitting diode pixel driving circuit in operation according to the fifth embodiment of the invention, which includes three phases: the initialization phase t51, the signal loading phase t52 and the light emitting phase t53.

In the initialization phase t51, both of the fifth switch transistors Ts5 in the organic light emitting diode pixel driving circuit according to the fifth embodiment of the invention are turned on, so the reset signal Reset can be loaded to the gates of the two driving transistors Td to thereby eliminate an influence of a signal displayed in a previous frame on the display of a next frame of image.

In the signal loading phase t52, the fifth switch transistors Ts5 in the organic light emitting diode pixel driving circuit according to the fifth embodiment of the invention are turned off, so a function of the organic light emitting diode pixel driving circuit according to the fifth embodiment of the invention is the same as the function of the organic light emitting diode pixel driving circuit according to the third embodiment of the invention, so a repeated description thereof will be omitted here.

In the light emitting phase t53, the fifth switch transistors Ts5 in the organic light emitting diode pixel driving circuit according to the fifth embodiment of the invention are turned off, so a function of the organic light emitting diode pixel driving circuit according to the fifth embodiment of the invention is the same as the function of the organic light emitting diode pixel driving circuit according to the third embodiment of the invention, so a repeated description thereof will be omitted here.

An organic light emitting diode pixel driving circuit according to a sixth embodiment of the invention includes an external circuit and a number m of intra-pixel circuits, each of intra-pixel circuits is located inside one of pixel elements and the m intra-pixel circuits are connected with the same data line, where m is larger than or equal to 2 and smaller than or equal to the total number of pixel elements connected with the same data line.

An operation principle of the organic light emitting diode pixel driving circuit will be described in the sixth embodiment below with reference to FIG. 6, which illustrates only two of the intra-pixel circuits as an example, and an operation principle of the m intra-pixel circuits is the same as the operation principle of the two intra-pixel circuits. As illustrated in FIG. 6, the organic light emitting diode pixel driving circuit according to the sixth embodiment of the invention includes a first intra-pixel circuit x and a second intra-pixel circuit y, where the first intra-pixel circuit x and the second intra-pixel circuit y are any two different ones of the m intra-pixel circuits.

The external circuit 31 includes a first switch transistor Ts1, where a first pole of the first switch transistor Ts1 receives an image data signal Data, a gate of the first switch transistor Ts1 receives a first scan signal Scan1, and a second pole of the first switch transistor Ts1 is connected respectively with first poles of driving transistors Td and second poles of the second switch transistor Ts2 of the m intra-pixel circuits;

Each of the intra-pixel circuits includes a second switch transistor Ts2, a third switch transistor Ts3, a fourth switch transistor Ts4, the driving transistor Td and a first capacitor C1;

In each of the intra-pixel circuits, a first pole of the second switch transistor Ts2 receives a first power supply signal Vdd, a gate of the second switch transistor Ts2 receives a first light emitting control signal EM1, and a second pole of the second switch transistor Ts2 respectively with the second pole of the first switch transistor Ts1 and the first pole of the driving transistor Td;

In each of the intra-pixel circuits, a first pole plate of the first capacitor C1 receives the first power supply signal Vdd, and a second pole plate the first capacitor C1 is connected with a gate of the driving transistor Td and also with a first pole of the fourth switch transistor Ts4;

In each of the intra-pixel circuits, a source of the driving transistor Td is connected with the second pole of the first switch transistor Ts1 and also connected with the second pole of the second switch transistor Ts2, a drain of the driving transistor Td is connected respectively with a first pole of the third switch transistor Ts3 and a second pole of the fourth switch transistor Ts4, and the gate of the driving transistor Td is connected with the second pole plate of the first capacitor C1 and the second pole of the fourth switch transistor Ts4;

In each of the intra-pixel circuits, a gate of the third switch transistor Ts3 receives a second light emitting control signal EM2, the first pole of the third switch transistor Ts3 is connected with the drain of the driving transistor Td and the second pole of the fourth switch transistor Ts4, and a second pole of the third switch transistor Ts3 is connected with an anode of an organic light emitting diode;

In each of the intra-pixel circuits, a gate of the fourth switch transistor Ts4 receives a second scan signal Scan2, the first pole of the fourth switch transistor Ts4 is connected with the second pole plate of the first capacitor C1 and also connected with the gate of the driving transistor Td, and the second pole of the fourth switch transistor Ts4 is connected with the first pole of the third switch transistor Ts3; and In each of the intra-pixel circuits, the anode of the organic light emitting diode is connected with the second pole of the fourth switch transistor Ts4 and the drain of the driving transistor Td, and a cathode of the organic light emitting diode receives a second power supply signal Vss.

FIG. 11 illustrates an organic light emitting diode pixel driving circuit according to a seventh embodiment of the invention, and in addition to the circuit according to the sixth embodiment of the invention, each of the intra-pixel circuits further includes a fifth switch transistor Ts5, where the fifth switch transistor Ts5 includes a gate which receives a third scan signal Scan3, a first pole which receives a reset signal Reset, and a second pole which is connected with the gate of the driving transistor Td.

A display device according to an embodiment of the invention includes a plurality of the organic light emitting diode pixel driving circuits according to any one of the first embodiment to the seventh embodiment of the invention.

A first pole of a switch transistor as referred to in the embodiments of the invention can be a source (or a drain) of the switch transistor, and the second pole of the switch transistor can be the drain (or the source) of the switch transistor. If the source of the switch transistor is the first pole, then the drain of the switch transistor is the second pole; and if the drain of the switch transistor is the first pole, then the source of the switch transistor is the second pole.

Those skilled in the art can appreciate that the drawings are merely schematic diagrams of some preferred embodiments of the invention and the modules or flows in the drawings may not be necessarily required to implement the invention.

Those skilled in the art can appreciate that the modules in the devices according to the embodiments can be distributed in the devices of the embodiments as described in the embodiments or located in one or more devices other than these embodiments while being modified correspondingly. The modules in the foregoing embodiments can be combined into a module or further divided into a plurality of sub-modules.

The foregoing embodiments of the invention have been numbered merely for the convenience of their description but will not indicate any precedence of one embodiment over the other.

Evidently those skilled in the art can make various modifications and variations to the invention without departing from the spirit and scope of the invention. Thus the invention is also intended to encompass these modifications and variations thereto so long as the modifications and variations come into the scope of the claims appended to the invention and their equivalents.

What is claimed is:

1. An organic light emitting diode pixel driving circuit, comprising:

a common circuit; and a number m of intra-pixel circuits, wherein each of the intra-pixel circuits comprises:

a signal loading module, a driving transistor and an organic light emitting diode;

and a number m of pixel elements, wherein each of the intra-pixel circuits is located inside one of pixel elements and the m pixel elements are connected with a same data line;

and wherein m is greater than or equal to 2 and is less than or equal to a total number of pixel elements connected with the same data line, wherein:

a first terminal of the common circuit is configured to receive an image data signal, and a second terminal of the common circuit is connected with sources of the driving transistors of the m intra-pixel circuits, wherein the common circuit is shared by the m pixel elements, and configured to drive one of the m pixel elements to emit light operating together with the intra-pixel circuit in the pixel element;

for each of the signal loading modules, a first terminal of the signal loading module receives a first power supply signal, a second terminal of the signal loading module is connected with the source of the driving transistor of the intra-pixel circuit comprising the signal loading module, a third terminal of the signal loading module is connected with a gate of the driving transistor, a fourth terminal of the signal loading module is connected with a drain of the driving transistor, a fifth terminal of the signal loading module is connected with the organic light emitting diode of the intra-pixel circuit comprising the signal loading module, and the organic light emitting diode receives a second power supply signal, wherein each of the signal loading modules is configured:

to have its first terminal disconnected from its second terminal during a signal loading phase, to have its third terminal connected with its fourth terminal during the signal loading phase to thereby generate a drive signal from the image data signal received by the second terminal of the signal loading module and to store the drive signal, to have its third terminal disconnected from its fourth terminal during a light emitting phase, to have its fourth terminal disconnected from its fifth terminal during the signal loading phase, to have its fourth terminal connected with its fifth terminal, to have its first terminal connected with its second terminal, and to control the driving transistor by the drive signal stored during the signal loading phase and a signal at the source of the driving transistor so as to drive the organic light emitting diode of the intra-pixel circuit comprising the signal loading module to emit light during the light emitting phase, and to have its third terminal connected with its fourth terminal and to have its fourth terminal connected with its fifth terminal during an initialization phase which precedes the signal loading phase so as to reset a signal at the gate of the driving transistor to the second power supply signal, and wherein the common circuit is configured to have its first terminal connected with its second terminal during the signal loading phase, and to have its first terminal disconnected from its second terminal during the light emitting phase;

wherein in the light emitting phase, the drain current of the driving transistor is independent from a threshold voltage of the driving transistor, and depends on voltage of the first power supply signal and voltage of the image data signal;

wherein a first waiting phase is between the signal loading phase and the initialization phase and a second waiting phase is between the signal loading phase and the light emitting phase, wherein each of the signal loading modules is further configured to have its third terminal disconnected from its fourth terminal and to have its fourth terminal disconnected from its fifth terminal during the first waiting phase and the second waiting phase, and the common circuit is further configured to have its first terminal disconnected from its second terminal during the first waiting phase and to have its first terminal disconnected from its second terminal during the second waiting phase.

2. The circuit according to claim 1, wherein the common circuit comprises a first switch transistor, wherein a first pole of the first switch transistor is the first terminal of the common circuit, a gate of the first switch transistor receives a first scan signal, and a second pole of the first switch transistor is the second terminal of the common circuit, and wherein the first switch transistor is configured to be turned on during the signal loading phase and to be turned off during the light emitting phase.

3. The circuit according to claim 1, wherein each of the signal loading modules comprises:

a first switch element, a second switch element, and a drive signal generation and storage element, wherein a first terminal of the first switch element is the first terminal of the signal loading module, and a second terminal of the first switch element is the second terminal of the signal loading module, wherein a first terminal of the second switch element is the fourth terminal of the signal loading module, and a second terminal of the second switch element is the fifth terminal of the signal loading module, wherein a first terminal of the drive signal generation and storage element is the first terminal of the signal loading module, a second terminal of the drive signal generation and storage element is the third terminal of the signal loading module, and a third terminal of the drive signal generation and storage element is the fourth terminal of the signal loading module, wherein both the first switch element and the second switch element are configured to be turned off during the signal loading phase and to be turned on during the light emitting phase, and wherein the drive signal generation and storage element are configured such that, in response to a gate line, connected with the pixel element where the intra-pixel circuit comprising the signal loading module is located, being enabled during the signal loading phase, the second terminal is connected with the third terminal to thereby generate the drive signal from the image data signal at the source of the driving transistor of the intra-pixel circuit comprising the drive signal generation and storage element and to store the drive signal, wherein during the remaining period of the signal loading phase and the light emitting phase, the drive signal generation and storage element are configured such that the second terminal is disconnected from the third terminal, and wherein during the light emitting phase, the drive signal generation and storage element are configured to control the driving transistor by the drive signal stored in the signal loading phase such that the signal at the source of the driving transistor drives the organic light emitting diode of the intra-pixel circuit comprising the signal loading module to emit light.

4. The circuit according to claim 3, wherein first switch element comprise a second switch transistor, wherein:

a first pole of the second switch transistor is the first terminal of the first switch element, a gate of the second switch transistor receives a first light emitting control signal, and a second pole of the second switch transistor is the second terminal of the first switch element, and the second switch transistor is configured to be turned off during the signal loading phase and to be turned on during the light emitting phase.

5. The circuit according to claim 3, wherein the second switch element comprises a third switch transistor, and wherein:

a first pole of the third switch transistor is the first terminal of the second switch element, a gate of the third switch transistor receives a second light emitting control signal, and a second pole of the third switch transistor is the second terminal of the second switch element, and the third switch transistor is configured to be turned off during the signal loading phase and to be turned on during the light emitting phase.

6. The circuit according to claim 3, wherein the drive signal generation and storage element comprises a fourth switch transistor and a first capacitor, wherein:

one terminal of the first capacitor is the first terminal of the drive signal generation and storage element, and the other terminal of the first capacitor is the second terminal of the drive signal generation and storage element, a first pole of the fourth switch transistor is the second terminal of the drive signal generation and storage element, a gate of the fourth switch transistor receives a second scan signal, which is the same as a signal on the gate line connected with the pixel element where the intra-pixel circuit comprising the drive signal generation and storage element is located, and a second pole of the fourth switch transistor is the third terminal of the drive signal generation and storage element;

the fourth switch transistor is configured to be turned on in response to the gate line, connected with the pixel element where the intra-pixel circuit comprising the drive signal generation and storage element is located, being enabled during the signal loading phase and to be turned off during the remaining period of the signal loading phase and during the light emitting phase, and the first capacitor is configured to store the drive signal.

7. An organic light emitting diode pixel driving circuit, comprising:

a common circuit;

a number m of intra-pixel circuits; and a number m of pixel elements, wherein each of the intra-pixel circuits is located inside one of pixel elements and the m pixel elements are connected with a same data line, and wherein m is greater than or equal to 2 and less than or equal to a total number of pixel elements connected with the same data line, wherein:

the common circuit comprises a first switch transistor, the first switch transistor comprises a first pole which receives an image data signal, and a gate which receives a first scan signal, wherein the common circuit is shared by the m pixel elements, and configured to drive one of the m pixel elements to emit light operating together with the intra-pixel circuit in the pixel element;

each of the intra-pixel circuits comprises a second switch transistor, a third switch transistor, a fourth switch transistor, a driving transistor, a first capacitor and an organic light emitting diode, the second switch transistor comprises a first pole which receives a first power supply signal, and a gate which receives a first light emitting control signal, the first capacitor comprises one pole plate which receives the first power supply signal, and another pole plate which is connected with a gate of the driving transistor and a first pole of the fourth switch transistor, the driving transistor comprises a source which is connected with a second pole of the first switch transistor and a second pole of the second switch transistor, and a drain which is connected with a first pole of the third switch transistor and a second pole of the fourth switch transistor, the third switch transistor comprises a gate which receives a second light emitting control signal, and a second pole which is connected with an anode of an organic light emitting diode, the fourth switch transistor comprises a gate which receives a second scan signal, and the organic light emitting diode comprises a cathode which receives a second power supply signal;

wherein the first switch transistor and the fourth switch transistor are configured to be turned on in the signal loading phase and to be turned off in a light emitting phase, the second switch transistor and the third switch transistor are configured to be turned off in the signal loading phase and to be turned on in a light emitting phase;

wherein in the light emitting phase, the drain current of the driving transistor is independent from a threshold voltage of the driving transistor, and depends on voltage of the first power supply signal and voltage of the image data signal, wherein during an initialization phase which precedes the signal loading phase, the gate of the first switch transistor receives a turn-off signal provided by the first scan signal to turn off the first switch transistor, the gate of the second switch transistor receives a turn-off signal provided by the first light emitting control signal to turn off the second switch transistor, the gate of the third switch transistor receives an enabling signal provided by the second light emitting control signal to turn on the third switch transistor, the gate of the fourth switch transistor receives an enabling signal provided by the second scan signal to turn on the fourth switch transistor; the third switch transistor and the fourth switch transistor are turned on so that a signal at the gate of the driving transistor is reset to the second power supply signal;

wherein during a first waiting phase between the signal loading phase and the initialization phase, and a second waiting phase between the signal loading phase and the light emitting phase, the gate of the third switch transistor receives a turn-off signal provided by the second light emitting control signal to turn off the third switch transistor, the gate of the fourth switch transistor receives a turn-off signal provided by the second scan signal to turn off the fourth switch transistor; and the gate of the first switch transistor receives the turn-off signal provided by the first scan signal to turn off the first switch transistor.

8. The circuit according to claim 7, wherein each of the intra-pixel circuits further comprises a fifth switch transistor, and wherein the fifth switch transistor comprises a gate which receives a third scan signal, a first pole which receives a reset signal, and a second pole which is connected with the gate of the driving transistor.

* * * * *